US007013989B2

(12) United States Patent
Hammond et al.

(10) Patent No.: US 7,013,989 B2
(45) Date of Patent: Mar. 21, 2006

(54) ACOUSTICAL TELEMETRY

(75) Inventors: Blake Thomas Hammond, Houston, TX (US); Joel D. Shaw, Houston, TX (US); David W. Teale, Spring, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 50 days.

(21) Appl. No.: 10/367,645

(22) Filed: Feb. 14, 2003

(65) Prior Publication Data

US 2004/0159428 A1 Aug. 19, 2004

(51) Int. Cl.
*E21B 47/18* (2006.01)

(52) U.S. Cl. ..... 175/40; 367/82; 367/189

(58) Field of Classification Search ..... 367/81–86; 175/107; 181/102, 139
See application file for complete search history.

(56) References Cited

U.S. PATENT DOCUMENTS

| | | | | |
|---|---|---|---|---|
| 3,065,416 A | * | 11/1962 | Jeter | 175/40 |
| 3,305,825 A | * | 2/1967 | Godbey | 367/85 |
| 4,167,000 A | | 9/1979 | Bernard et al. | |
| 4,545,241 A | | 10/1985 | Alder | |
| 4,597,067 A | * | 6/1986 | Bockhorst et al. | 367/82 |
| 4,941,951 A | | 7/1990 | Sheppard et al. | |
| 5,941,305 A | | 8/1999 | Thrasher et al. | |
| 6,017,198 A | * | 1/2000 | Traylor et al. | 417/390 |
| 6,041,856 A | | 3/2000 | Thrasher et al. | |
| 6,142,228 A | | 11/2000 | Jogi et al. | |

FOREIGN PATENT DOCUMENTS

| | | | |
|---|---|---|---|
| GB | 870076 | * | 6/1961 |
| RU | 2038471 | | 6/1995 |
| SU | 1109511 | | 8/1984 |
| SU | 1240874 | | 6/1986 |

OTHER PUBLICATIONS

U.K. Search Report, Application No. GB 0403249.6, dated Aug. 12, 2004.

* cited by examiner

*Primary Examiner*—David Bagnell
*Assistant Examiner*—Giovanna M. Collins
(74) *Attorney, Agent, or Firm*—Patterson & Sheridan, L.L.P.

(57) ABSTRACT

Method, apparatus and article of manufacture for monitoring and characterizing the operation of a transducer (i.e., motor or pump) downhole. In particular, transducer RPMs are determined by analysis of acoustic information. An acoustical source (signal generator) located on a downhole tool (e.g., a drill string) creates acoustic energy which is received and processed by a receiving unit, which may be located at the surface of a wellbore. The acoustical source is operably connected to the transducer, so that the frequency of the signal produced by the acoustical source corresponds to the speed of the transducer. The acoustic signal of the acoustical source may then be isolated from other acoustical energy produce by downhole equipment, such as a drill bit. Having determined transducer speed by isolation of the acoustic signal, other operating parameters may be determined. Illustrative operating parameters include torque, flow, pressure, horsepower, and weight-on-bit.

37 Claims, 7 Drawing Sheets

ACOUSTICAL TELEMETRY

BACKGROUND OF THE INVENTION

1. Field of the Invention

Embodiments of the present invention generally relate to a method and apparatus of acoustically transmitting data to and from downhole environments.

2. Description of the Related Art

To recover oil and gas from subsurface formations, wellbores/boreholes are drilled by rotating a drill bit attached at an end of a drill string. The drill string includes a drill pipe or a coiled tubing (referred herein as the "tubing") coupled to a bottomhole assembly (BHA) which, in turn, carries the drill bit at its end. The drill bit is rotated by, for example, operation of a mud motor disposed in the BHA. In this case, a drilling fluid commonly referred to as the "mud" is supplied under pressure from a surface source into the tubing during drilling of the wellbore and through the mud motor. The pressurized drilling fluid (mud) acts as a motive fluid to operate the mud motor and is then discharged at the drill bit bottom. The drilling fluid then returns to the surface via the annular space (annulus) between the drill string and the wellbore wall or casing wall. In addition to operating the mud motor, the drilling fluid serves to clean the workface at the bit and carry the drill cuttings back to the surface, lubricate and cool the drill bit, and stabilize the wellbore that is formed to prevent its collapse.

From time to time, conditions may arise which mitigate the effectiveness of the motor of a drill string in performing its above listed functions and may even damage the motor. For example, the motor may stall during operation. A motor may stall for a number of reasons including setting down too much weight-on-bit, running into a tight area and pinching the bit-box, a stator failure, etc. It is both expensive and time-consuming to pull the motor out of the wellbore each time there is doubt as to whether the motor is turning.

Another undesirable condition which may arise downhole is a leak between the interior and the exterior of the drill pipe to create a "short circuit" which reduces the effectiveness of the drilling fluid in performing its functions. If such a leak goes undetected and is allowed to persist over time, the flow of the drilling fluid, which is typically loaded with solids, will erode or wash away enough of the material of the drill pipe at the location of the leak as to weaken the pipe to the point of separation (twist off). Lost pipe in the bottom of the well prevents further drilling of the well until such time as the separated portion is retrieved or "fished" from the well. Fishing operations are time consuming and expensive and not always successful. If unsuccessful, the well must be abandoned and a new well or a sidetrack begun. Even if successful, the fishing operation presents a significant financial loss.

Another detrimental event that may occur is a flow restriction or blockage, which also interferes with the effectiveness of the drilling fluid. Furthermore, a total blockage has been known to cause a rapid increase in hydraulic pressure in the drill string with eventual rupture of the drill string or the standpipe which feeds the drilling fluid to the drill string at the earth's surface. Again, such a condition inhibits successful drilling and results in increased operating expenses.

As a result of these and other conditions which may occur downhole, there is a need for effectively monitoring and characterizing the motor system of a drill pipe. Conventionally, the relevant operating parameters which are observed during operation of a motor during drilling include torque, RPMs, pressure and flow. These parameters may be used individually or collectively to characterize the operation of the motor. For example, in the event of a motor stall, blockage or restriction the pressure drop in the motor is expected to increase above the operating pressure. As another example, RPMs and torque of a positive displacement motor are computed using information on flow rate and pressure drop. Such a computation is facilitated by characteristic curves contained in performance charts provided by manufacturers of downhole motors. However, such approaches are not always accurate. For example, depending on the particular problem, the pressure may not exhibit any change, regardless of the condition of the motor. Furthermore, there is a significant time delay in the pressure indication when drilling with a compressible medium, such as in the case of underbalanced drilling using nitrogen.

Another technique for monitoring and characterizing the operation of a motor downhole is by acoustics. For example, one approach is to determine drill bit speed by isolating the rotor whirl frequency of a progressive cavity motor. However, this technique is limited because some motors do not create a strong acoustical signature all the time. Often, it is not possible to acoustically differentiate a stalled motor from a rotating motor.

Therefore, there is a need for a method and apparatus for monitoring and characterizing the operation of a motor downhole. Preferably, the monitoring and characterization occurs in real-time so that continues efficient motor operation can be insured.

SUMMARY OF THE INVENTION

The present invention generally relates to a method and apparatus for monitoring and characterizing the operation of a motor downhole. In particular, motor RPMs are determined by analysis of acoustic information.

One embodiment provides a method of generating an acoustic signal at a downhole drilling apparatus. The method includes providing an acoustic source operably connected to a transducer; operating the transducer; and in response to operating the transducer, operating the acoustic source to generate the acoustic signal, the acoustic signal having a predetermined acoustic signature.

Another embodiment provides a method of determining a speed of a transducer while downhole in a wellbore. The method includes providing an acoustic source operably connected to the transducer so that operation of the transducer at any given speed causes operation of the acoustic source to generate an acoustic signal having a frequency related to the given speed. During operation of the transducer, the acoustic source generates the acoustic signal which is then detected to determine the given speed of the motor.

Yet another embodiment provides a computer readable medium containing a program which, when executed, performs an operation, comprising: receiving acoustic energy generated by an apparatus operating downhole in a wellbore, the apparatus comprising a transducer and an acoustic signal generator operably connected to the transducer; isolating, from the acoustic energy, an acoustic signature of the acoustic signal generator; and determining a speed of the transducer based on the isolated acoustic signature.

Still another embodiment provides an apparatus for use in a wellbore, comprising: a transducer and an acoustic source operably connected to the transducer so that operation of the transducer at any given speed causes operation of the acoustic source to generate an acoustic signal having a frequency corresponding to the given speed.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
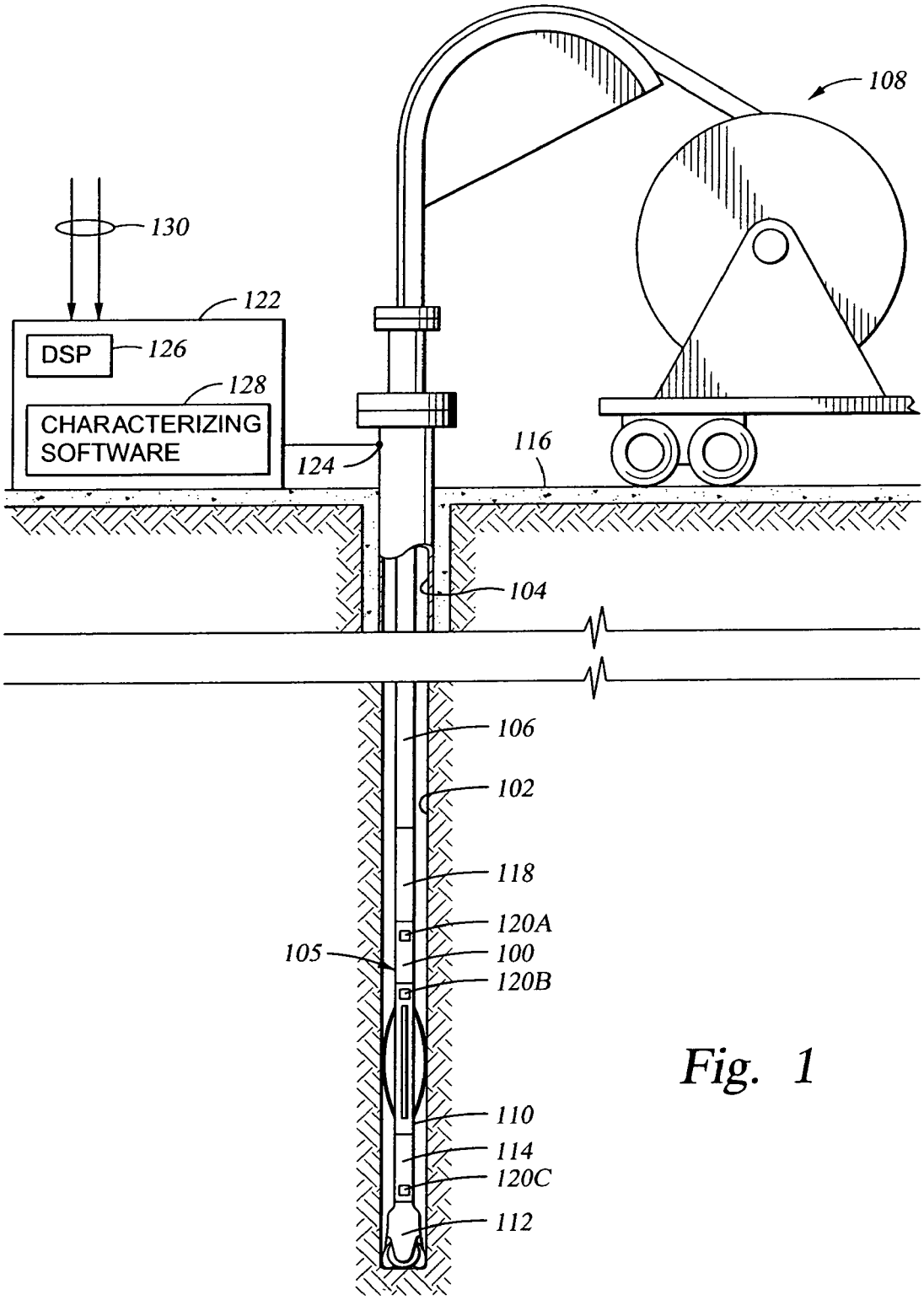
FIG. 1 is a schematic cross sectional view of a drill string and bottomhole assembly downhole.

The present invention generally relates to a method and apparatus for monitoring and characterizing the operation of a transducer downhole. A transducer refers to any apparatus which converts one form of energy to another, e.g., motive fluid energy to mechanical rotational energy. Particular embodiments of a transducer are a motor and a pump. Accordingly, specific embodiments of the present invention are described with reference to a motor or a pump. However, in each case, the invention is adaptable to either. Thus, references to a "motor" or a "pump" are merely for purpose of illustration and are not limiting of the invention.

In one embodiment of the present invention, the operation of a transducer downhole is characterized by the transducer's RPMs, which may be determined by analysis of acoustic information. An acoustical source (signal generator) located on a downhole tool (e.g., a drill string) creates acoustic energy which is received and processed by a receiving unit, which may be located at the surface of a wellbore. The acoustical source is operably connected to the transducer, so that the frequency of the signal produced by the acoustical source is directly related to the speed of the transducer. Operably connected means any relationship (e.g., mechanical) between the acoustical source and the transducer whereby the speed of the transducer is reflected by the signal of the acoustical source. The acoustic signal of the acoustical source may then be isolated from other acoustical energy produce by downhole equipment, such as the drill bit. Having determined transducer speed, other operating parameters may be determined. Illustrative operating parameters include torque, flow, pressure, horsepower, and weight-on-bit.

Aspects of the invention will be described with reference to a positive displacement apparatus, such as a progressive cavity apparatus. Progressive cavity apparatus are helical gear mechanisms which are frequently used in oil field applications, for pumping fluids or driving downhole equipment in the wellbore. A typical progressive cavity apparatus is designed according to the basics of a gear mechanism patented by Moineau in U.S. Pat. No. 1,892,217, incorporated by reference herein, and is generically known as a "Moineau" pump or motor. The mechanism has two helical gear members, where typically an inner gear member rotates within a stationary outer gear member. In some mechanisms, the outer gear member rotates while the inner gear member is stationary and in other mechanisms, the gear members counter rotate relative to each other. Typically, the outer gear member has one helical thread more than the inner gear member. The gear mechanism can operate as a pump for pumping fluids or as a motor through which fluids flow to rotate an inner gear so that torsional forces are produced on an output shaft. Therefore, the terms "pump" and "motor" may refer to the same (structurally) apparatus, which is characterized by the manner in which it is being used. In any case, it should be understood that the invention is not limited to a particular apparatus, whether pump or motor, and that reference to a progressive cavity motor (or other particular motor type) is merely for purposes of illustration.

In one embodiment of the present invention, the operation of a transducer downhole is characterized by the transducer's RPMs, which may be determined by analysis of acoustic information. An acoustical source (signal generator) located on a downhole tool (e.g., a drill string) creates acoustic energy which is received and processed by a receiving unit, which may be located at the surface of a wellbore. The acoustical source is operably connected to the transducer, so that the frequency of the signal produced by the acoustical source is directly related to the speed of the transducer. Operably connected means any relationship (e.g., mechanical) between the acoustical source and the transducer whereby the speed of the transducer is reflected by the signal of the acoustical source. The acoustic signal of the acoustical source may then be isolated from other acoustical energy produced by downhole equipment, such as the drill bit. Having determined transducer speed, other operating parameters may be determined. Illustrative operating parameters include torque, flow, pressure, horsepower, and weight-on-bit.

In addition to those described above, the bottom hole assembly 105 may include a variety of other components and devices suitable for use with the progressive cavity motor 100. For example, the bottom hole assembly 105 may include a measurement-while-drilling (MWD) tool and/or a near-bit mechanic's (NBM) tool, collectively referenced in FIG. 1 as tool 118. By way of illustration the tool 118 may include a two-axis magnetometer to monitor rotation of the bottom hole assembly 105, a three-axis accelerometer to detect motion of the bottom hole assembly 105, a strain gauge to measure weight-on-bit, torque-on-bit and bending moment in two orthogonal directions. Additionally or alternatively, the tool 118 may include directional sensors for inclination and azimuth measurements, gamma ray resistivity, density and other measurements. During drilling, the tool 118 may be operated to take readings which can be returned to the surface by a form of telemetry.

Figure 2:
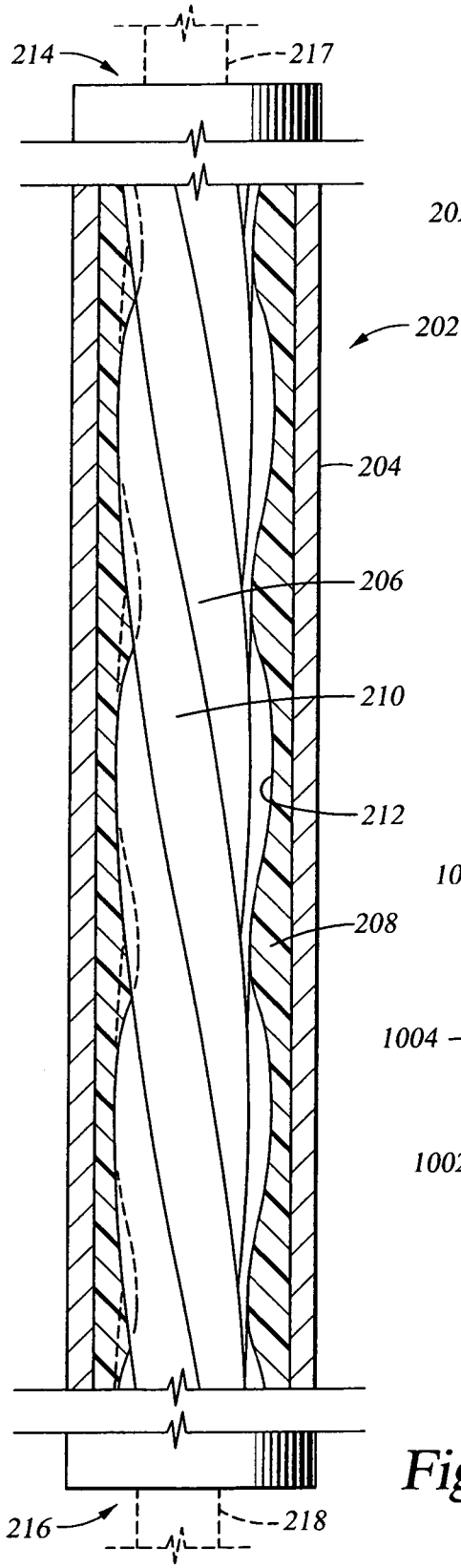
FIG. 2 is a schematic side cross sectional view of a progressive cavity transducer (e.g., motor), which may be part of the bottomhole assembly of FIG. 1.
Figure 3:
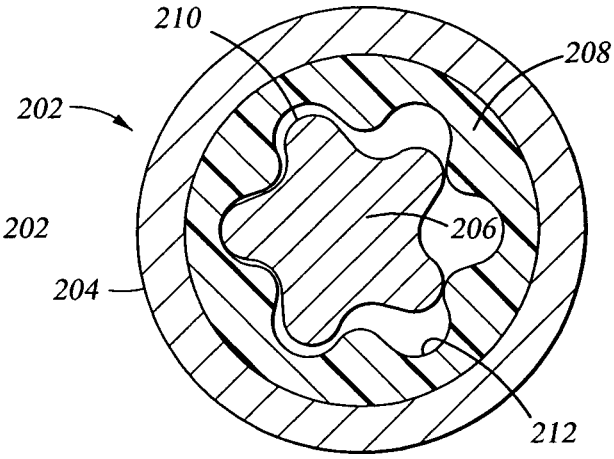
FIG. 3 is a schematic top cross sectional view of the progressive cavity motor of FIG. 2.

FIG. 2 is a schematic cross sectional view of a power section 202 of the progressive cavity motor 100. FIG. 3 is a schematic cross sectional view of the power section 202 shown in FIG. 2. Similar elements are similarly numbered and the figures will be described in conjunction with each other. The power section 202 includes an outer stator 204 formed about an inner rotor 206. The rotor 206 is coupled to a shaft 217 at an upper end and an output shaft 218 at a lower end. The stator 204 typically carries an elastomeric member 208 on an inner surface thereof. The rotor 206 includes a plurality of gear teeth 210 formed in a helical thread pattern around the circumference of the rotor 206. The stator 204 includes a plurality of gear teeth 212 for receiving the rotor gear teeth 210 and typically includes one more tooth for the stator 204 than the number of gear teeth in the rotor 206. The rotor gear teeth 210 are produced with matching profiles and a similar helical thread pitch compared to the stator gear teeth 212 in the stator 204. Thus, the rotor 206 can be matched to and inserted within the stator 204. The rotor 206 typically can have from one to nine teeth, although other numbers of teeth can be made.

Each rotor tooth 210 forms a cavity with a corresponding portion of the stator tooth 212 as the rotor 206 rotates. The number of cavities, also known as stages, determines the amount of pressure that can be produced by the progressive cavity motor 102. The rotor 206 flexibly engages the elastomeric member 208 as the rotor 206 turns within the stator 204 to effect a seal therebetween. The amount of flexible engagement is referred to as a compressive or interference fit.

In operation, fluid flowing down through the tubular member 106 enters the power section 202 at an opening 214 at an upper end to create hydraulic pressure. The hydraulic pressure causes the rotor 206 of the progressive cavity motor 100 to rotate within the stator 204. In addition to rotating about its own axis, the rotor 206 also precesses about a central axial axis of the stator 204. Fluid which enters the opening 214 progresses through the cavities (represented as cavity 220) formed between the stator 204 and the rotor 206, and out a second opening 216.

This operation provides output torque to the output shaft 218 connected to the rotor 206. At its other end, the output shaft 218 is coupled to the cutting tool 112 (shown in FIG. 1). Although not shown, it is understood that the output shaft may extend axially through the stabilizer sub 110 and the tool (spacer) 114 (see FIG. 1).

Regardless of the particular makeup and operation of the bottom hole assembly 105, one aspect of the invention is the provision of an acoustic source 120 (FIG. 1), also referred to herein as a noisemaker. In general, the acoustic source 120 is adapted to create a predetermined acoustic signal which is anomalous and non-characteristic of its environment and has a frequency, or frequencies, corresponding to that of the progressive cavity motor 100. It is contemplated that the acoustic signal may, or may not, be embedded in a carrier wave. Since the frequency of the acoustic signal need only "correspond" to transducer, e.g., the progressive cavity motor 100, it is not necessary that the acoustic signal have the same frequency of the transducer, so long as the frequency of the transducer can be derived therefrom. For example, it may be desirable to transmit the acoustic signal at a frequency being some multiple of the transducer frequency. Since the relationship between the acoustic signal frequency and the transducer frequency is known, the transducer frequency may be derived from the acoustic signal frequency.

The acoustic signal is received by a receiving unit 122, which may be located at the surface of the wellbore 102. As such, the receiving unit 122 includes a signal sensor 124 which may be a microphone, a transducer, or any other device capable of sensing acoustic energy. Illustratively, the signal sensor 124 is shown disposed against the casing 104. However, the particular medium through which the signal sensor 124 receives the acoustic signal is not limiting of the invention. As such, it is contemplated that the acoustic signal is received through, for example, the earth 116 and/or through the drilling fluid in the wellbore 102. In one embodiment, the receiving unit 122 includes a digital signal processing unit 126 which may include any combination of software and hardware capable of isolating the frequency signature of the acoustic signal. Isolation by the digital signal processing unit 126 is facilitated because the signal is predetermined, and anomalous and non-characteristic of its environment. In that the signal is predetermined, the characteristics of the signal can be actively targeted in a noisy environment. Filtration/isolation from noise is further facilitated by virtue of being anomalous and non-characteristic relative to the ambient. In a particular embodiment, the receiving unit 122 is a laptop computer, whereby a high degree of mobility is achieved.

The acoustic signal may generated by any of a variety of techniques including mechanically, hydraulically, pneumatically and electrically. For example, the acoustic signal may be generated by direct physical interaction or by hydraulic interaction between components associated with the rotating member(s) of the bottom hole assembly 105 which drives the cutting tool 112. In another aspect, mechanical interaction between the rotating member and other components operates an electrical component configured to issue the acoustic signal detectable by the receiving unit 122. In any case, the acoustic source 120 may be located at position on the bottomhole assembly 105 where the rotation of the motor 102 can be harnessed. Since the rotation of the motor 102 is transferred to other components of the bottomhole assembly 105, the location of the acoustic source 120 is not limited to the motor 102 itself. Accordingly, in FIG. 1, three instances of the acoustic source 120A–C are shown. Specifically, one instance of the acoustic source 120A is shown located in/on the progressive cavity motor 100, another is shown located in/on the stabilizing sub 110 and yet another is shown located in/on the tool 114 (e.g., spacer mill). Again, the particular location of the acoustic source 120 is not limiting of the invention. Particular embodiments of the acoustic source 120 are described below with reference to FIGS. 4–13. The embodiments of the acoustic source 120 of FIGS. 4–10 and 11–13 may be characterized as mechanical and hydraulic, respectively. However, as noted, the acoustic source 120 is not so limited and any signal generator capable of transmitting a signal directly related to the rotating caused by the motor 102 is within the scope of the invention.

Figure 4:
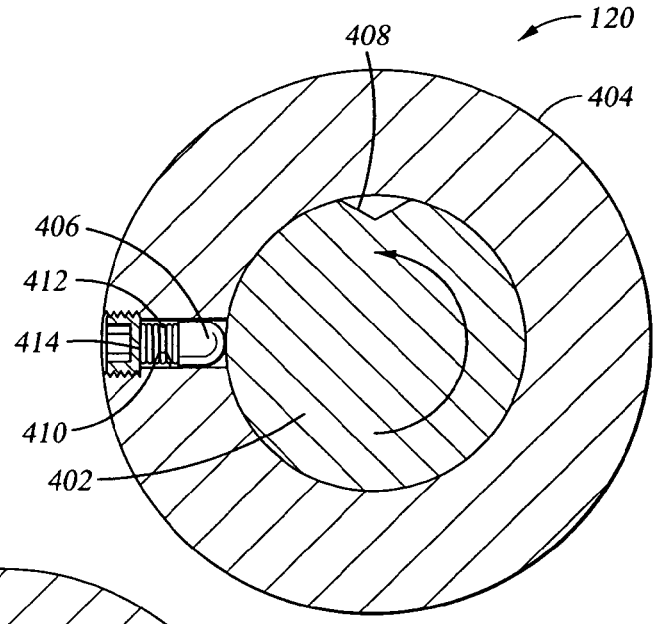
FIG. 4 is a schematic top cross sectional view of a housing and rotating member incorporating an acoustic source, shown in a first position.
Figure 5:
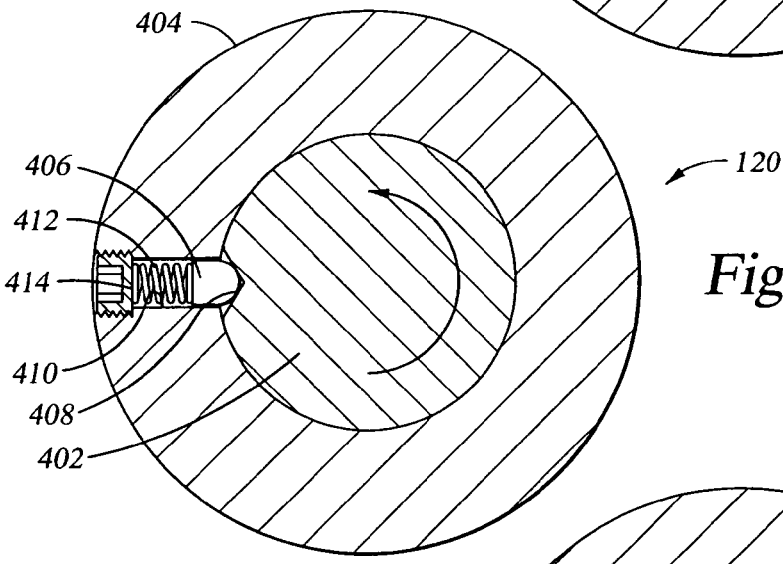
FIG. 5 is a schematic top cross sectional view of the apparatus of FIG. 4 shown in a second position, in which the acoustic source generates an acoustic signal.
Figure 6:
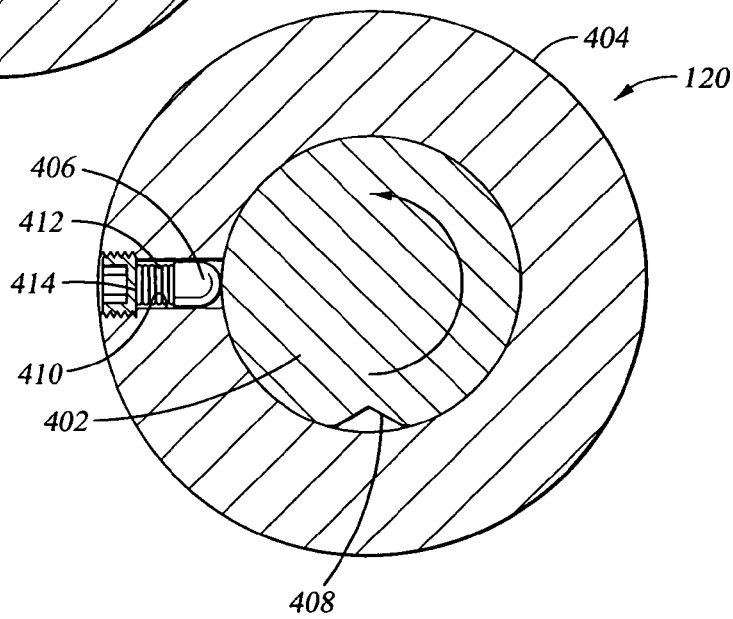
FIG. 6 is a schematic top cross sectional view of the apparatus of FIG. 4 shown in a third position, following disengagement of the acoustic source.

FIGS. 4–6 show one embodiment of the acoustic source 120. In general, a rotating member 402 is shown concentrically and rotatably disposed in a housing 404. The rotating member 402 and the housing 404 are highly simplified so as to be representative of any corresponding components in the bottomhole assembly 105 (FIG. 1). For example, the rotating member 402 may be the output shaft 218 and the housing 404 may be the housing cylinder of the stabilizer sub 110. In another embodiment, the housing 404 is the stator 204 and the rotating member 402 is the rotor 206 of the power section 202 (FIGS. 2 and 3). The acoustic source 120 generally comprises a plunger 406 (i.e., a striker) and a corresponding detent 408 formed in the rotating member 402. The plunger 406 is slidably disposed in a recess 410 formed in the housing 404. A biasing member 412 disposed between the recess floor 414 and plunger 406 urges the plunger 406 outward toward the rotating member 402. Illustratively, the biasing member 412 is a spring, although any form of a biasing member could be used such as an elastomer or magnet (where the plunger 406 is a magnetic material of opposite polarity).

The acoustic signal may generated by any of a variety of techniques including mechanically, hydraulically, pneumatically and electrically. For example, the acoustic signal may be generated by direct physical interaction or by hydraulic interaction between components associated with the rotating member(s) of the bottom hole assembly 105 which drives the cutting tool 112. In another aspect, mechanical interaction between the rotating member and other components operates an electrical component configured to issue the acoustic signal detectable by the receiving unit 122. In any case, the acoustic source 120 may be located at position on the bottomhole assembly 105 where the rotation of the motor 100 can be harnessed. Since the rotation of the motor 100 is transferred to other components of the bottomhole assembly 105, the location of the acoustic source 120 is not limited to the motor 100 itself. Accordingly, in FIG. 1, three instances of the acoustic source 120A–C are shown. Specifically, one instance of the acoustic source 120A is shown located in/on the progressive cavity motor 100, another is shown located in/on the stabilizing sub 110 and yet another is shown located in/on the tool 114 (e.g., spacer mill). Again, the particular location of the acoustic source 120 is not limiting of the invention. Particular embodiments of the acoustic source 120 are described below with reference to FIGS. 4–13. The embodiments of the acoustic source 120 of FIGS. 4–10 and 11–13 may be characterized as mechanical and hydraulic, respectively. However, as noted, the acoustic source 120 is not so limited and any signal generator capable of transmitting a signal directly related to the rotating caused by the motor 100 is within the scope of the invention.

Figure 7:
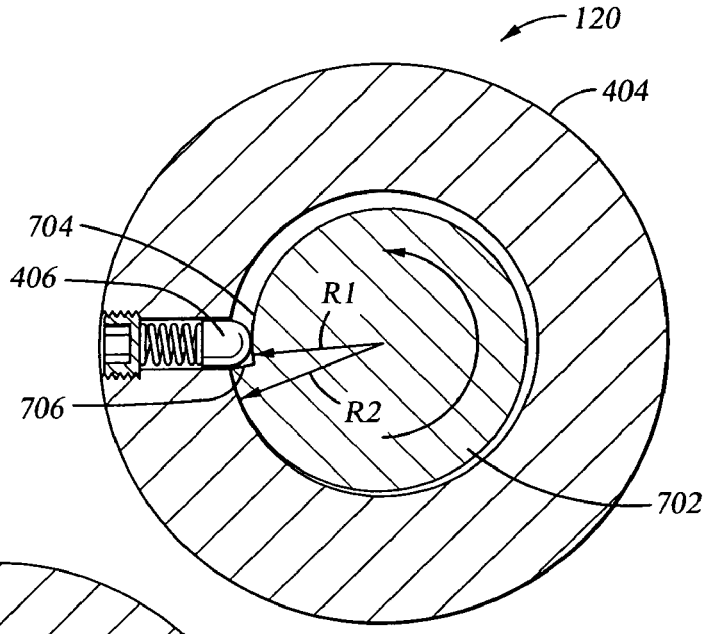
FIGS. 7–9 show, in a cross sectional view, three positions of an alternative embodiment of the acoustic source incorporated into a housing and rotating member.
Figure 8:
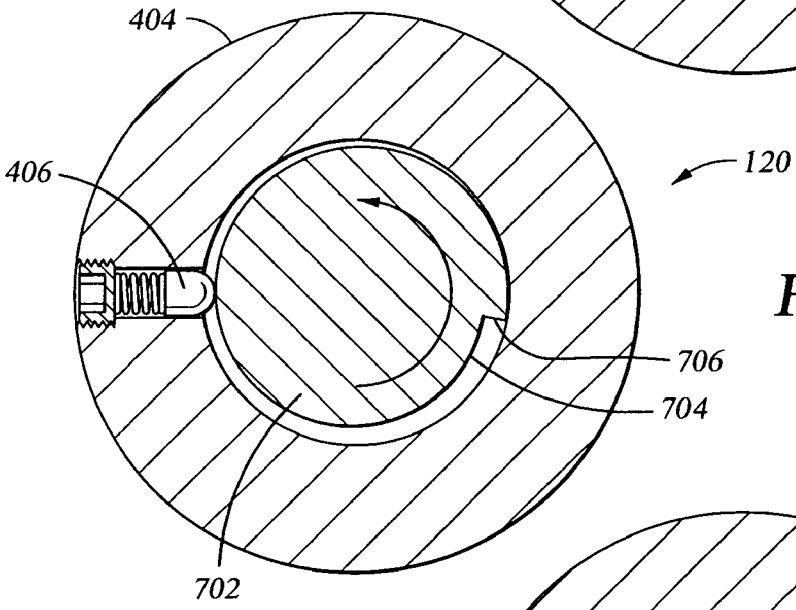
Figure 9:
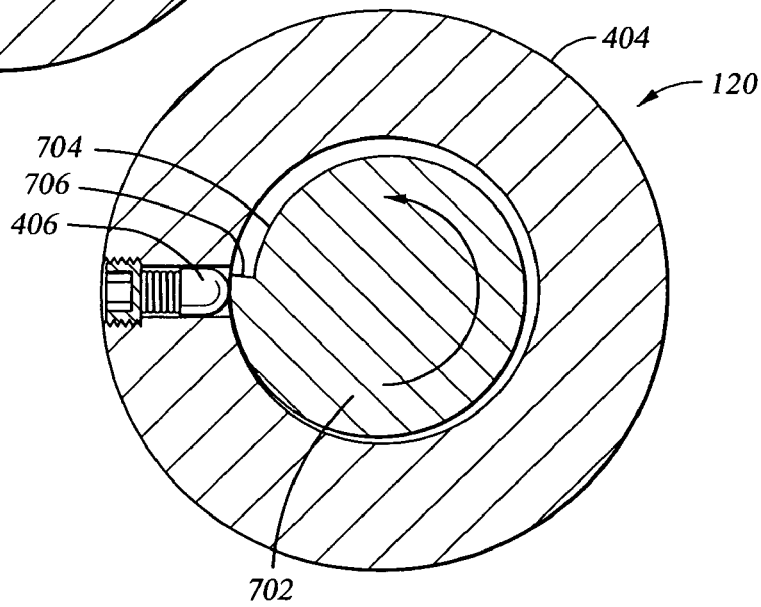

FIGS. 7–9 show another embodiment of the acoustic source 120. For simplicity and brevity, components similar or identical to those described above with reference to FIGS. 4–6 are identified by like reference numbers, and will not be described begin in detail. As in the embodiment described above with reference to FIGS. 4–6, the acoustic source 120 shown in FIGS. 7–9 includes a spring biased plunger 406. In contrast to the previous embodiment, however, the outer surface 704 of the rotating member 702 progressively diametrically increases from a first radius R1 to a second radius R2, where R2 is greater than R1. In operation, the rotating member 702 rotates (illustratively counterclockwise), while the plunger 406 slides over the ramped outer surface 704. FIG. 7 shows an illustrative position at the beginning of a cycle and FIG. 8 shows a subsequent position of the acoustic source 120. FIG. 9 shows a position of the acoustic source 120 immediately prior to the plunger 406 crossing the step 706, at which point the potential energy of the plunger 406 is maximized. Upon continued rotation, the plunger 406 clears the step 706 and is accelerated toward the outer surface 704 at the first radius R1. Contact between the plunger 406 and the outer surface 704 creates an acoustic signal capable of being detected by the receiving unit 122.

Figure 10:
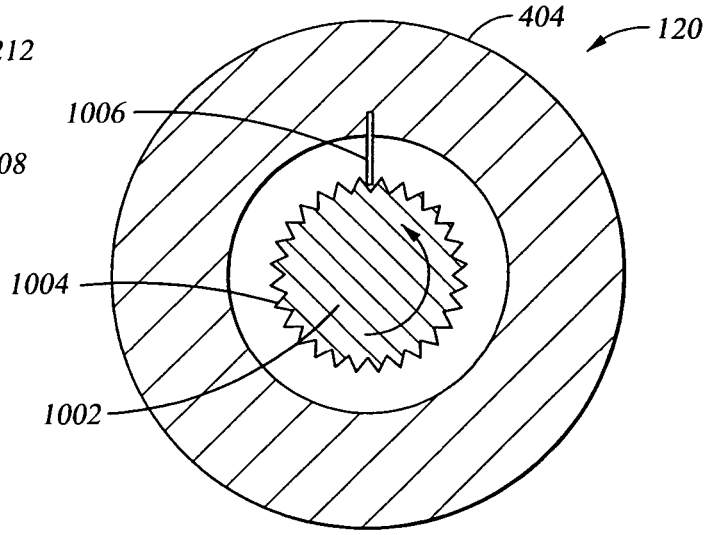
FIG. 10 shows yet another embodiment of the acoustic source incorporated into a housing and rotating member.

Yet another embodiment of the acoustic source 120 is shown in FIG. 10. In this case, the rotating member 1002 is configured with a plurality of teeth 1004 on its outer surface. A pawl 1006 is rigidly secured in the housing 404 and in contact with the plurality of teeth 1004. During rotation of the rotating member 1002, the pawl 1006 makes a detectable sound upon clearing each tooth 1004. For a known number of teeth 1004, the acoustic source 120 generates an acoustic signal of known frequency.

Figure 11:
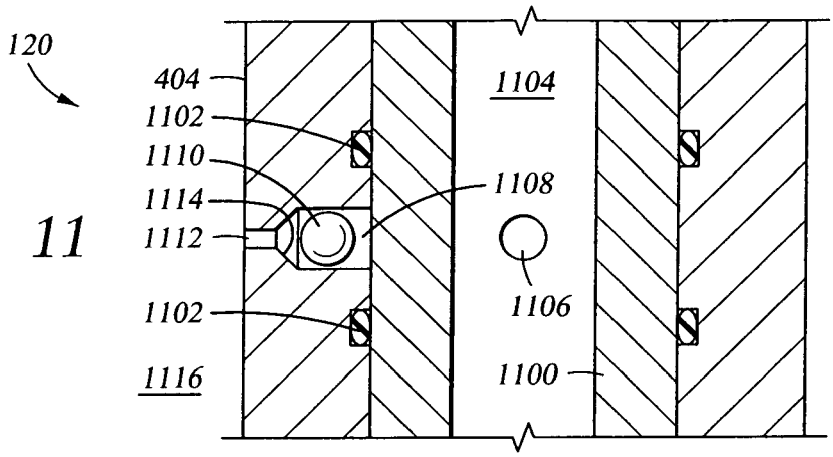
FIG. 11 shows, in a side cross sectional view, yet another embodiment of the acoustic source incorporated into a housing and rotating member, wherein the acoustic source is disengaged.
Figure 12:
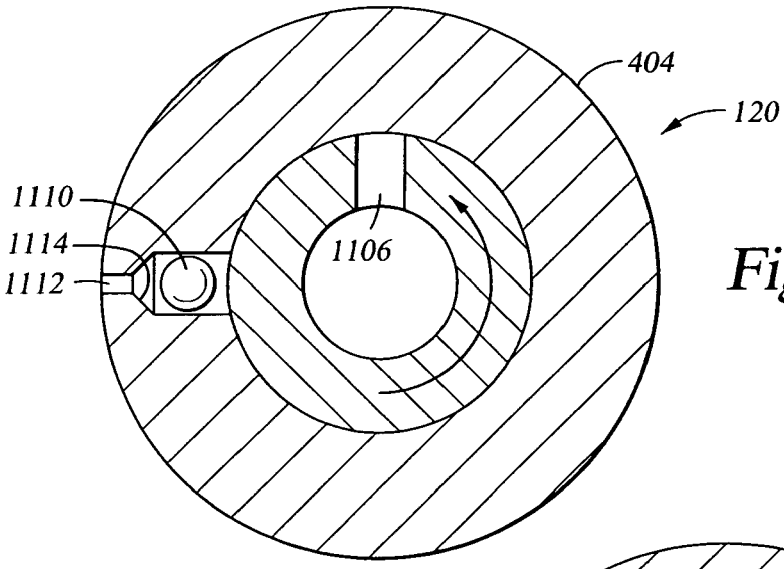
FIG. 12 shows the apparatus of FIG. 11 in a top cross sectional view.

Still another embodiment of the acoustic source 120 is shown in FIG. 11 and FIG. 12. FIG. 11 is a side cross-sectional view and FIG. 12 is a top cross-sectional view. Where as the previously described embodiment of the acoustic source 120 may be characterized as mechanical, the embodiment of FIGS. 11–12 may be characterized as hydraulic. In general, FIGS. 11–12 show a rotating member, i.e., a tubular 1100, rotatably disposed within a housing 404. A pair of O-rings 1102 carried on the inner diameter of the housing 404 form fluid-tight seals with respect to the tubular 1100. The tubular 1100 has an axial bore 1104 formed therein, and a radially disposed rotating communication port 1106 allows fluid communication between the axial bore 1104 and the ambient environment of the tubular 1100. In particular, the communication port 1106 is at a common axial height with a ball chamber 1108. The ball chamber 1108 is sized to accommodate a ball 1110, and allow movement of the ball 1110 within the chamber 1108. The ball chamber 1108 is coupled with a low-pressure region 1116 via an opening 1112. The ball chamber 1108 tapers diametrically inwardly to the opening 1112, thereby forming a ball seat 1114 which prevents the ball 1110 from moving through the opening 1112.

Figure 13:
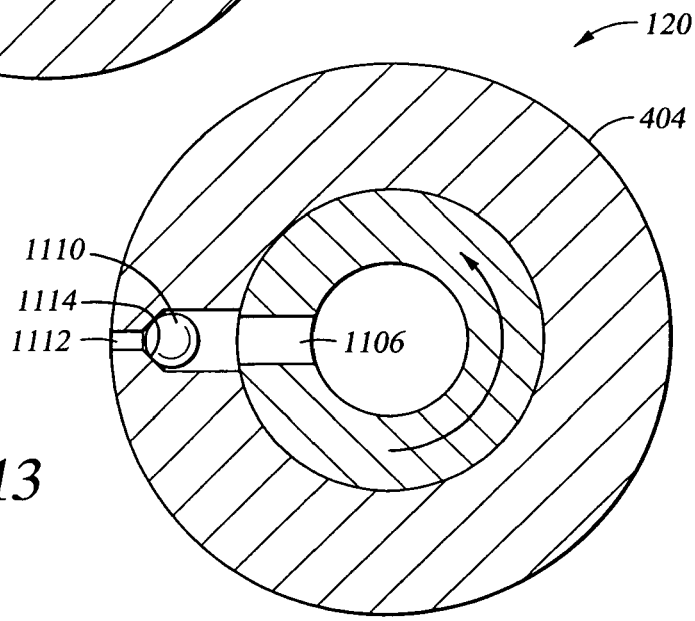
FIG. 13 shows the apparatus of FIGS. 11 and 12 in a top cross sectional view, wherein the acoustic source is hydraulically engaged.

In operation, a pressure gradient is established between the bore 1104 (a high-pressure region) and the low-pressure region 1116. The low-pressure region 1116 may be the annulus between the inner diameter of wellbore casing and the outer diameter of the housing 404, in which the flow of drilling fluid causes a pressure drop. By periodically communicating a high-pressure region with the low-pressure region, the ball 1110 is caused to contact the ball seat 1114. Specifically, the high-pressure region and the low-pressure region are communicated once per revolution of the tubular 1100. FIGS. 11–12 show the communication port 1106 rotated out of alignment with the ball chamber 1108. Accordingly, the ball 1110 is disengaged from the seat 1114. Once the communication port 1106 is brought into alignment with the ball chamber 1108, the ball 1110 is urged against the seat 1114 by the pressure gradient between the high-pressure region in the bore 1104 and the low-pressure region 1116, as shown in FIG. 13.

In each of the foregoing embodiments, the acoustic source 120 produces an acoustic having a unique signature signature. Since the signature of the acoustic signal of the acoustic source 120 (regardless of its particular design) can be predetermined, the receiving unit 122 can be configured to isolate the acoustic signal. Once isolated, the RPMs of the motor 100 can be determined. As such, aspects of the invention provide a cost-effective method and apparatus for real-time determination of motor RPMs while the motor is downhole.

Figure 14:
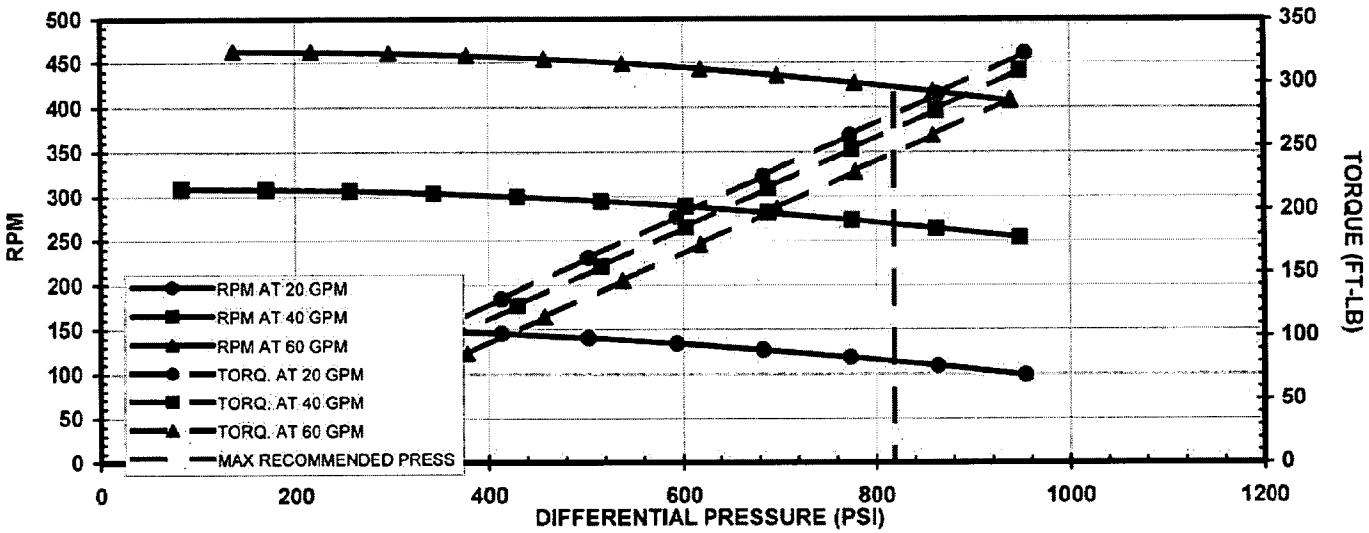
FIG. 14 is a theoretical performance chart based on Moineau formulas relating RPMs, differential pressure, torque, and flow.
Figure 15:
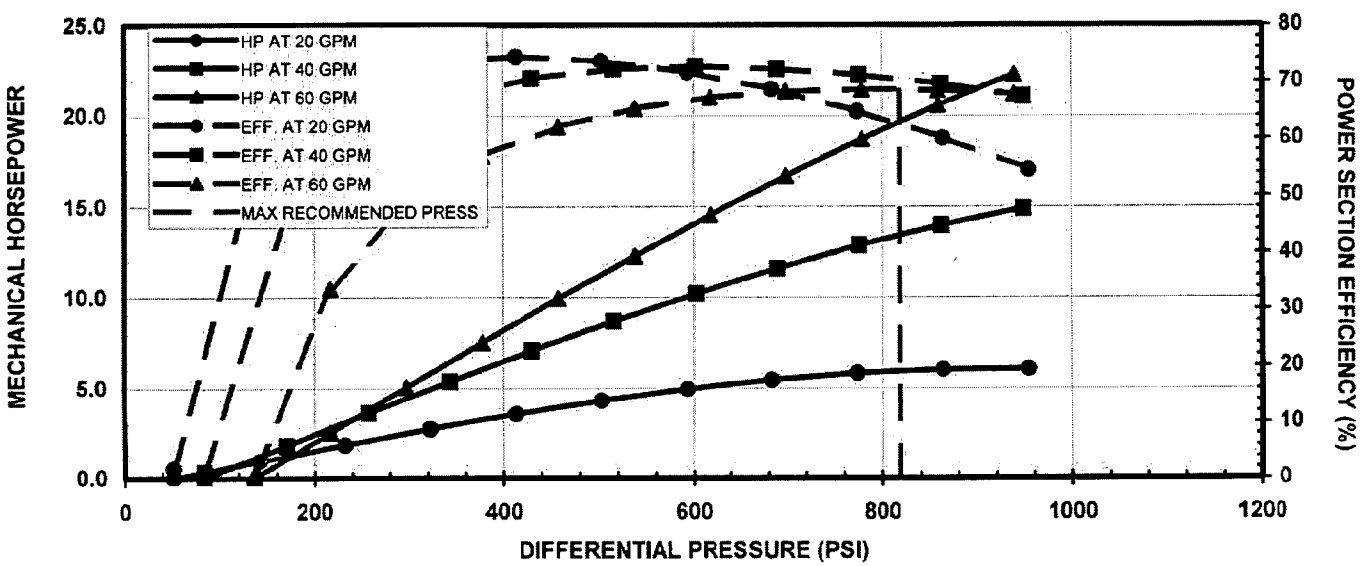
FIG. 15 is a theoretical performance chart based on Moineau formulas relating mechanical horsepower, differential pressure, power section efficiency and flow.
Figure 16:
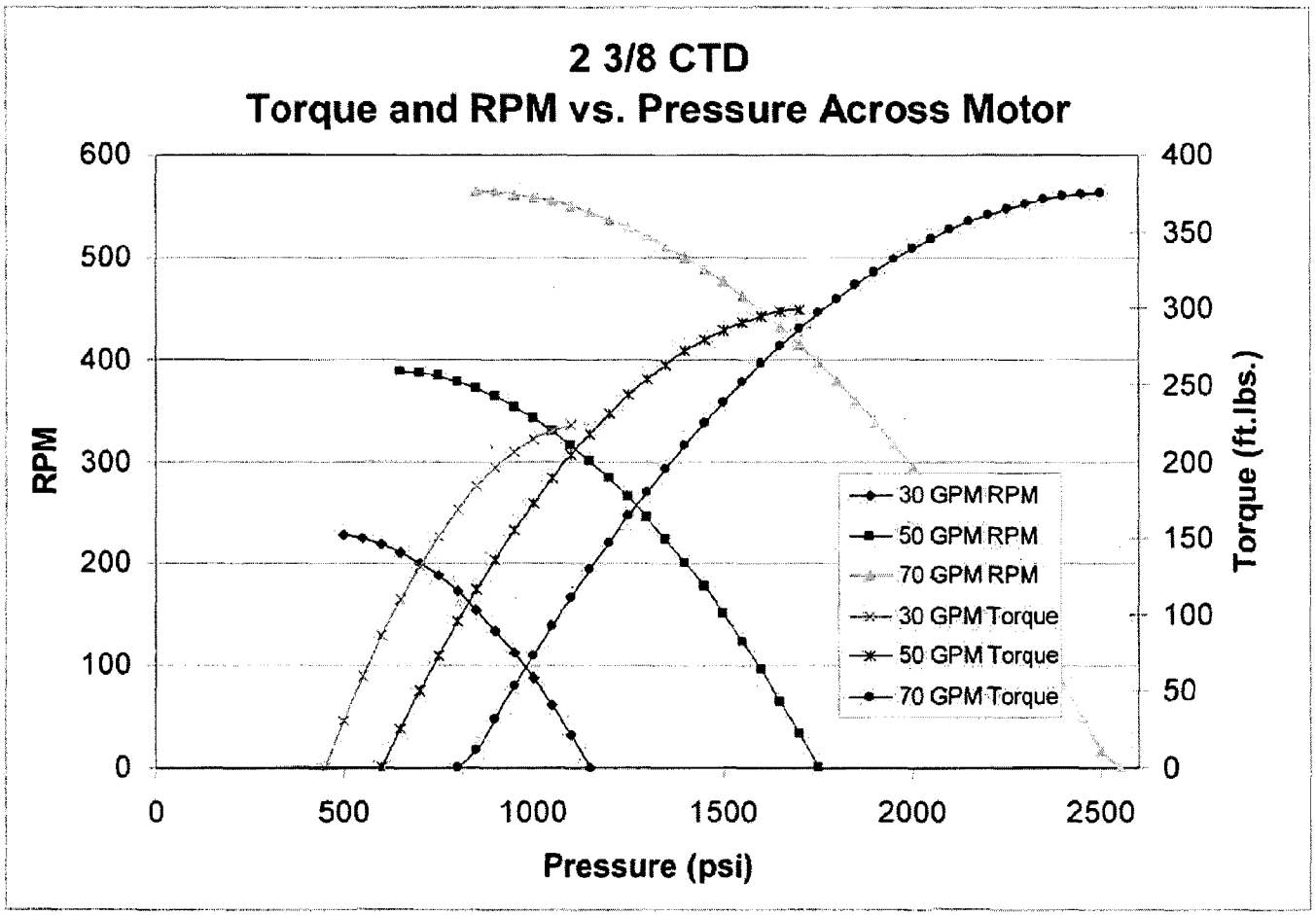
FIG. 16 is a performance chart based on actual performance of a motor and relates RPMs, pressure, torque and flow.

Having determined motor RPMs according to aspects of the invention, other operational parameters of the motor can be determined. For example, is well known that the operational parameters torque, RPMs, pressure and flow are interrelated based upon the design characteristics of the motor. Theoretical performance charts can be derived for these operational parameters using the well-known Moineau formulas. For purposes of illustration, FIGS. 14 and 15 show to theoretical performance charts based on Moineau formulas. Specifically, FIG. 14 shows a chart relating RPMs, differential pressure, torque, and flow, while FIG. 15 shows a chart relating mechanical horsepower, differential pressure, power section efficiency and flow. In contrast, FIG. 16 shows a performance chart based on actual performance of a motor attached to a 2⅜ diameter coil tubing and relates RPMs, pressure, torque and flow.

In addition to the foregoing operating parameters, it is contemplated that other operating parameters can be derived through testing and performance mapping, once having determined motor RPMs according to the present invention. One such parameter is weight-on-bit (WOB).

Having determined motor RPMs according to aspects of the invention, other operational parameters of the motor can be determined. For example, is well known that the operational parameters torque, RPMs, pressure and flow are interrelated based upon the design characteristics of the motor. Theoretical performance charts can be derived for these operational parameters using the well-known Moineau formulas. For purposes of illustration, FIGS. 14 and 15 show two theoretical performance charts based on Moineau formulas. Specifically, FIG. 14 shows a chart relating RPMs, differential pressure, torque, and flow, while FIG. 15 shows a chart relating mechanical horsepower, differential pressure, power section efficiency and flow. In contrast, FIG. 16 shows a performance chart based on actual performance of a motor attached to a 2⅜ diameter coil tubing and relates RPMs, pressure, torque and flow.

While some embodiments have been described in the context of fully functioning computers and computer systems, those skilled in the art will appreciate that the various embodiments of the invention are capable of being distributed as a program product in a variety of forms, and that embodiments of the invention apply equally regardless of the particular type of signal bearing media used to actually carry out the distribution. Examples of signal bearing media include, but are not limited to, recordable type media such as volatile and nonvolatile memory devices, floppy and other removable disks, hard disk drives, optical disks (e.g., CD-ROMs, DVDs, etc.), and transmission type media such as digital and analog communication links. Transmission type media include information conveyed to a computer by a communications medium, such as through a computer or telephone network, and includes wireless communications. The latter embodiment specifically includes information downloaded from the Internet and other networks. Such signal-bearing media, when carrying computer-readable instructions that direct the functions of the present invention, represent embodiments of the present invention.

While the foregoing is directed to embodiments of the present invention, other and further embodiments of the invention may be devised without departing from the basic scope thereof, and the scope thereof is determined by the claims that follow.

What is claimed is:

1. A method of generating an acoustic signal in a wellbore, comprising:

providing a transducer configured to operate on or be operated by a fluid;

providing an acoustic source comprising a first member and a second member and operably connected to the transducer so that a speed of the transducer is reflected by a signal of the acoustic source;

flowing fluid through the transducer; and in response to flowing fluid through the transducer, operating the acoustic source to generate the acoustic signal by causing the first member to periodically impact the second member.

2. The method of claim 1, wherein the acoustic signal has a predetermined acoustic signature anomalous and non-characteristic of an ambient environment of the transducer.

3. The method of claim 1, wherein the transducer is a motor.

4. The method of claim 1, wherein the transducer is a pump.

5. The method of claim 1, wherein the transducer comprises a motor operably connected to a cutting tool.

6. The method of claim 1, wherein the first member is a striking member and the second member is a striking surface.

7. The method of claim 6, wherein the striking member is disposed on a housing and the striking surface is formed on a rotating member rotatably disposed in the housing.

8. The method of claim 1, wherein providing the transducer comprises providing a housing and a rotating member rotatably disposed in the housing.

9. The method of claim 8, wherein the first member is a striking member disposed on the housing and the second member is a striking surface formed on the rotating member.

10. The method of claim 9, wherein the acoustic signal is generated at a frequency directly related to relative rotation between the housing and the rotating member.

11. The method of claim 1, further comprising:

detecting the acoustic signal;

determining the given speed of the transducer based on the detected acoustic signal; and determining at least one other operating parameter of the transducer based on the determined given speed.

12. The method of claim 11, wherein the transducer is one of a fluid driven motor and a fluid driving pump.

13. The method of claim 11, wherein the at least one other operating parameter of the transducer is flow rate, torque, horsepower, or pressure across the transducer.

14. The method of claim 11, wherein the transducer comprises a motor operably connected to a bit and the at least one other operating parameter of the motor comprises weight-on-bit.

15. A computer readable medium containing a program which, when executed, performs an operation, comprising:

receiving acoustic energy generated by an apparatus operating downhole in a wellbore, the apparatus comprising a transducer and an acoustic signal generator operably connected to the transducer, wherein the transducer comprises a motor operably connected to a bit;

isolating, from the acoustic energy, an acoustic signature of the acoustic signal generator;

determining a speed of the transducer based on the isolated acoustic signature; and determining weight-on-bit of the transducer based on the determined given speed.

16. An apparatus for generating an acoustic signal in a wellbore, comprising:

a transducer configured to operate on or be operated by a fluid flowing therethrough; and an acoustic source comprising a first member and a second member and operably connected to the transducer so that operation of the transducer at any given speed causes operation of the acoustic source to generate an acoustic signal having a frequency related to the given speed by causing the first member to periodically impact the second member.

17. The apparatus of claim 16, wherein the transducer is a motor operably connected to a cutting tool.

18. The apparatus of claim 16, wherein the first member is a striking member and the second member is a striking surface.

19. The apparatus of claim 18, wherein the striking member is disposed on a housing and the striking surface is formed on a rotating member rotatably disposed in the housing, so that the impact is caused by relative rotation between the housing and the rotating member.

20. The apparatus of claim 19, wherein the rotating member is an output shaft coupled to a cutting tool.

21. The apparatus of claim 16, further comprising a receiving unit configured for detecting the acoustic signal.

22. The apparatus of claim 16, further comprising a receiving unit configured for:

detecting acoustic energy produced by the acoustic source and the transducer, including the acoustic signal; and isolating the acoustic signal of the acoustic source.

23. The apparatus of claim 22, wherein the receiving unit is further configured for determining the given speed of the transducer based on the isolated acoustic signal.

24. The apparatus of claim 23, wherein the receiving unit is further configured for determining at least one other operating parameter of the transducer based on the determined given speed of the transducer.

25. The apparatus of claim 24, wherein the at least one other operating parameter of the transducer is flow rate, torque, horsepower, or pressure across the transducer.

26. The apparatus of claim 24, wherein the transducer comprises a motor carrying a bit and the at least one other operating parameter of the motor comprises weight-on-bit.

27. An apparatus for use in drilling a wellbore, comprising:

a transducer; and an acoustic source operably connected to the transducer so that operation of the transducer at any given speed causes operation of the acoustic source to generate an acoustic signal having a frequency related to the given speed, wherein the acoustic source comprises a striking member disposed on a housing and a striking surface formed on a rotating member rotatably disposed in the housing, so that periodic contact between the striking member and striking surface, caused by relative rotation between the housing and the rotating member, generates the acoustic signal and the rotating member is an output shaft coupled to a cutting tool.

28. An apparatus for use in drilling a wellbore, comprising:

a transducer comprising a motor carrying a bit;

an acoustic source operably connected to the transducer so that operation of the transducer at any given speed causes operation of the acoustic source to generate an acoustic signal having a frequency related to the given speed, a receiving unit configured for:

detecting acoustic energy produced by the acoustic source and the transducer, including the acoustic signal;

isolating the acoustic signal of the acoustic source;

determining the given speed of the transducer based on the isolated acoustic signal; and determining weight-on-bit based on the determined given speed of the transducer.

29. A method of generating an acoustic signal in a wellbore, comprising:

providing a transducer configured to operate on or be operated by a fluid;

providing an acoustic source operably connected to the transducer so that a speed of the transducer is reflected by a signal of the acoustic source;

flowing fluid through the transducer; and in response to flowing fluid through the transducer, operating the acoustic source to generate the acoustic signal, wherein operating the acoustic source to generate the acoustic signal comprises striking a striking member against a surface at a frequency directly related to a speed of the transducer.

30. A method of generating an acoustic signal in a wellbore, comprising:

providing a transducer configured to operate on or be operated by a fluid;

providing an acoustic source operably connected to the transducer so that a speed of the transducer is reflected by a signal of the acoustic source;

flowing fluid through the transducer; and in response to flowing fluid through the transducer, operating the acoustic source to generate the acoustic signal, wherein providing the acoustic source comprises providing a striking member disposed on a housing and a striking surface formed on a rotating member rotatably disposed in the housing, so that periodic contact between the striking member and striking surface generate the acoustic signal.

31. A method of generating an acoustic signal in a wellbore, comprising:

providing a transducer comprising a housing and a rotating member rotatably disposed in the housing and configured to operate on or be operated by a fluid;

providing an acoustic source operably connected to the transducer so that a speed of the transducer is reflected by a signal of the acoustic source, wherein providing the acoustic source comprises providing a striking member disposed on the housing and a striking surface formed on the rotating member, so that periodic contact between the striking member and striking surface generate the acoustic signal;

flowing fluid through the transducer; and in response to flowing fluid through the transducer, operating the acoustic source to generate the acoustic signal.

32. A method of generating an acoustic signal in a wellbore, comprising:

providing a transducer comprising a housing and a rotating member rotatably disposed in the housing and configured to operate on or be operated by a fluid;

providing an acoustic source operably connected to the transducer so that a speed of the transducer is reflected by a signal of the acoustic source, wherein providing the acoustic source comprises providing a striking member and a striking surface caused to contact one another to generate the acoustic signal at a frequency directly related to relative rotation between the housing and the rotating member;

flowing fluid through the transducer; and in response to flowing fluid through the transducer, operating the acoustic source to generate the acoustic signal.

33. A method of determining a speed of a transducer while downhole in a wellbore, comprising:

providing an acoustic source operably connected to the transducer so that operation of the transducer at any given speed causes operation of the acoustic source to generate an acoustic signal having a frequency related to the given speed;

operating the transducer, whereby the acoustic source is operated to generate the acoustic signal;

detecting the acoustic signal;

determining the given speed of the transducer based on the detected acoustic signal; and determining at least one other operating parameter of the transducer based on the determined given speed, wherein the transducer comprises a motor operably connected to a bit and the at least one other operating parameter of the motor comprises weight-on-bit.

34. An apparatus for generating an acoustic signal in a wellbore, comprising:

a transducer configured to operate on or be operated by a fluid flowing therethrough; and an acoustic source operably connected to the transducer so that operation of the transducer at any given speed causes operation of the acoustic source to generate an acoustic signal having a frequency related to the given speed, wherein the acoustic source comprises a striking member and a striking surface and wherein the striking member is configured to contact the striking surface at a frequency directly related to the given speed of the transducer.

35. An apparatus for generating an acoustic signal in a wellbore, comprising:

a transducer configured to operate on or be operated by a fluid flowing therethrough; and an acoustic source operably connected to the transducer so that operation of the transducer at any given speed causes operation of the acoustic source to generate an acoustic signal having a frequency related to the given speed, wherein the acoustic source comprises a striking member disposed on a housing and a striking surface formed on a rotating member rotatably disposed in the housing, so that periodic contact between the striking member and striking surface, caused by relative rotation between the housing and the rotating member, generates the acoustic signal.

36. The apparatus of claim 35, wherein the rotating member is an output shaft coupled to a cutting tool.

37. An apparatus for generating an acoustic signal in a wellbore, comprising:

a transducer configured to operate on or be operated by a fluid flowing therethrough;

an acoustic source operably connected to the transducer so that operation of the transducer at any given speed causes operation of the acoustic source to generate an acoustic signal having a frequency related to the given speed; and a receiving unit configured for:

detecting acoustic energy produced by the acoustic source and the transducer, including the acoustic signal;

isolating the acoustic signal of the acoustic source; and determining the given speed of the transducer based on the isolated acoustic signal; and determining at least one other operating parameter of the transducer based on the determined given speed of the transducer, wherein the transducer comprises a motor carrying a bit and the at least one other operating parameter of the motor comprises weight-on-bit.

* * * * *